US009108827B2

(12) United States Patent
Willim et al.

(10) Patent No.: US 9,108,827 B2
(45) Date of Patent: Aug. 18, 2015

(54) LATTICE MAST CRANE AND LATTICE MAST BOOM

(75) Inventors: Hans-Dieter Willim, Ulm-Unterweiler (DE); Roland Bohnacker, Blaubeuren (DE)

(73) Assignee: LIEBHERR-WERK EHINGEN GMBH, Ehingen/Donau (DE)

( * ) Notice: Subject to any disclaimer, the term of this patent is extended or adjusted under 35 U.S.C. 154(b) by 861 days.

(21) Appl. No.: 13/080,068

(22) Filed: Apr. 5, 2011

(65) Prior Publication Data

US 2012/0080397 A1 Apr. 5, 2012

(30) Foreign Application Priority Data

Apr. 6, 2010 (DE) ..... 20 2010 004 584 U

(51) Int. Cl.
*B66C 23/70* (2006.01)
*B66C 23/66* (2006.01)

(52) U.S. Cl.
CPC ..... *B66C 23/66* (2013.01); *B66C 23/70* (2013.01)

(58) Field of Classification Search
CPC ..... B66C 23/06; B66C 23/26; B66C 23/36; B66C 23/365; B66C 23/62; B66C 23/64; B66C 23/66; B66C 23/68; B66C 23/70; B66C 25/00; B66C 23/00; E02F 9/14
USPC ..... 212/347, 175, 176, 177
See application file for complete search history.

(56) References Cited

U.S. PATENT DOCUMENTS

| | | | | |
|---|---|---|---|---|
| 3,249,238 | A | 5/1966 | Hedeen | |
| 4,253,579 | A | 3/1981 | Williams | |
| 5,199,586 | A * | 4/1993 | Pech et al. | 212/175 |
| 7,954,657 | B2 * | 6/2011 | Holly et al. | 212/177 |
| 2012/0205336 | A1 * | 8/2012 | Han et al. | 212/347 |

FOREIGN PATENT DOCUMENTS

| | | |
|---|---|---|
| CN | 101880012 | * 11/2010 |
| WO | 2009/131442 | 10/2009 |

* cited by examiner

*Primary Examiner* — Sang Kim
*Assistant Examiner* — Juan Campos, Jr.
(74) *Attorney, Agent, or Firm* — Dilworth & Barrese LLP.

(57) ABSTRACT

A lattice mast crane having a lattice mast boom which can be luffed up in a vertical luffing plane and which comprises a pivotal connection piece, a plurality of lattice pieces releasably connectable to one another, and a head piece, with the lattice mast boom having a two-strand or multi-strand region, wherein at least one side part is releasably arranged at the pivotal connection piece and the two-strand or multi-strand region is arranged directly or indirectly at the pivotal connection piece and/or directly or indirectly at least one side part.

11 Claims, 5 Drawing Sheets

LATTICE MAST CRANE AND LATTICE MAST BOOM

BACKGROUND OF THE INVENTION

The present invention relates to a lattice mast crane having a lattice mast boom which can be luffed up in a vertical luffing plane and which comprises a pivotal connection piece, a plurality of lattice pieces releasably connectable to one another, and a head piece, with the lattice mast boom having a two-strand or multi-strand region.

With such lattice mast cranes, the lattice mast boom can be transported to the deployment site dismantled into its individual components and can be assembled on site by connecting the individual lattice pieces to the pivotal connection piece and to the head piece. The boom of the lattice boom crane is pivotally connected about a horizontal luffing axis to the superstructure of the crane in the working state and can thus be luffed up in the vertically extending luffing plane.

The boom of this lattice mast crane is usually guyed by a guying rope arrangement and is held thereby on the luffing of the boom. With lattice mast booms, in contrast to non-guyed telescopic booms, it is therefore not the deflection of the boom in the luffing plane which is the decisive criterion for the peak payloads when lifting large loads in a steep position, but rather the lateral deformation perpendicular to the luffing plane. If the lattice mast boom undergoes a laterally acting force, e.g. by the power of the wind, the lifting of a load with the already present excursion effects a larger lateral torque.

In known lattice mast booms, the lattice mast is in this respect built up of the pivotal connection piece, a single strand of lattice pieces connected to one another and the head piece so that the width of the boom corresponds to the width of the lattice pieces. To increase the lateral stiffness in such a construction, larger, in particular wider, lattice pieces must therefore be used. However, this represents a substantial cost factor since completely new crane boom parts have to be purchased and/or produced for lifting heavy loads. In another respect, it is necessary for the transport of the lattice boom that the transport size does not exceed the maximum permitted transport size for road transport.

A possible solution approach is known from DE 10 2009 016 033 A1 and is shown in FIGS. 1*a* and 1*b*. The lattice boom structure has a pivotal connection piece 1 which is pivotably supported at the superstructure of a crane about a horizontal pivot axis 5. A lower cross-beam 2 is furthermore used which forms the transition from the pivotal connection piece 1 to the two-strand region 11 of the boom and ensures the flow of force through the boom. A single-strand region 10 adjoins the upper end of the two-strand region 11, with an upper cross-beam 3 likewise being used here for the flow of force. The existing light lattice pieces from the luffing fly jib of the crane are used as the lattice pieces 21 for the two-strand region. To be able to provide an optimum lifting capacity, they are assembled rotated by 90° in comparison to a use in the luffing fly jib.

As can be seen from FIG. 1*a*, the longitudinal axis of the bolts used at the bolt connection sites 22 extends parallel to the luffing plane, i.e. out of the plane of the drawing. It is, however, disadvantageous in this respect that, in comparison with the usual assembly of the lattice boom, the used light lattice pieces 21 are rotated by 90° and thus represent a basic problem during the assembly of the crane. DE 10 2009 016 033 A1 also proposes the use of first and second lattice pieces for the use in the single-strand and two-strand regions of the lattice mast boom.

SUMMARY OF THE INVENTION

It is therefore the object of the present invention to provide a lattice mast crane which allows a consistent increase in the possible payload of the boom with only small investment costs. The usual worksteps in the assembly of the boom should furthermore be maintained.

This object is achieved in accordance with the invention by a lattice mast crane in accordance with the description herein. In this respect, the lattice mast crane has a lattice mast boom which can be luffed up in a vertical luffing plane and which includes a pivotal connection piece, a plurality of lattice pieces which can be releasably connected to one another and a head piece, with the lattice mast boom having a two-strand or multi-strand region which is directly or indirectly connected to the pivotal connection piece and which is directly or indirectly connected to the head piece. The use of at least two strands in the two-strand or multi-strand region of the lattice mast boom considerably increases the boom stability, as was explained in detail above. The size of the pivotal connection piece is, however, frequently only dimensioned for a single strand so that the construction of a multi-strand region, in particular from the lattice pieces of the main boom, is not possible.

In accordance with the invention, at least one side part is therefore releasably arranged laterally at the pivotal connection piece and the two-strand or multi-strand region connected to the pivotal connection piece is arranged directly at the pivotal connection piece and/or directly at the at least one side part. The widening of the pivotal connection piece allows the use of wider or heavier lattice mast pieces such as are used, for example, in the main boom in known lattice mast cranes. The spacing between the at least two boom strands, i.e. the spacing of the central axes of the lattice pieces to the central axis of the pivotal connection piece, can furthermore be varied and adapted to the demands in the respective crane use as required.

The head part of the crane can preferably likewise be equipped with at least one side part analog to the pivotal connection piece.

It is conceivable that the lattice pieces of the boom strands extending in parallel are arranged with at least one respective bolting point at the side part and with at least one bolting point at the pivotal connection piece. Provision can furthermore be made that the side parts have a prism shape with a triangular base surface, with a side surface of the side part extending along the side surface of the pivotal connection pieces for fastening. It is furthermore of advantage if the side parts are bolted to the pivotal connection piece in at least two corner points of the triangular shape. Furthermore, at least one side part can have further cross-guying arrangements or longitudinal guying arrangements for stabilization.

The pivotal connection piece advantageously has at least one lateral bolting site for fastening at least one side part. The side part can hereby be simply released from the pivotal connection piece, for example for observing the maximum permitted transport dimension. Particularly preferably at least one bolting site is provided at the side surfaces of the pivotal connection piece which extend parallel to the luffing plane. It is conceivable that two respective bolting sites are provided at both sides of the pivotal connection piece which extend parallel to the luffing plane, with them being arranged in the upper and lower side regions of the pivotal connection piece. Optionally, at least one side part per side surface can be fastened or bolted to the pivotal connection piece with the aid of the bolting sites, whereby the possible base for fastening the lattice pieces of the two-strand or multi-strand boom region are made larger or wider.

Provision can alternatively be made that the lattice pieces of the two-strand or multi-strand region are not directly connected to the pivotal-connection piece, but that rather an intermediate piece is inserted between the boom strands and the pivotal connection piece. A cross-beam is preferably used as the intermediate piece. It is bolted to the pivotal connection piece via corresponding bolting sites and serves the reception of the individual lattice pieces of the two-strand or multi-strand boom region. The base for receiving the boom strands is also widened by inserting the intermediate piece.

Provision can optionally be made that the one or more side parts at the pivotal connection piece are additionally bolted to the intermediate piece or to the cross-beam. The flow of force during the lifting work by the boom is hereby optimized. A triangular shape of the side parts is likewise preferred, with advantageously two corners of the triangle being bolted to the pivotal connection piece and the remaining corner being bolted to the intermediate piece. Furthermore, the triangular side part can have further cross-guying arrangements or longitudinal guying arrangements for stabilization.

In a preferred embodiment of the lattice crane in accordance with the invention, it has an additional single-strand boom region made from lattice pieces. Both regions, i.e. the two-strand or multi-strand region and the single-strand region, are advantageously composed of a plurality of lattice pieces having the same geometrical dimension. In this respect, use can be made of already existing lattice pieces of the main boom so that no additional investment costs or only slight additional investment costs result. The already existing heavy lattice pieces are, in accordance with one of the above-named embodiments, placed with at least one side part directly or indirectly onto the existing pivotal connection piece and extend, parallel to the pivotal connection piece in the direction of the boom head piece. This region has a particularly effective reinforcement which stabilizes the boom with respect to the laterally engaging forces. To achieve the desired lifting height, a single-strand boom region is preferably arranged between the two-strand or multi-strand region and is composed of identical lattice mast pieces.

Alternatively, the two-strand or multi-strand region can be equipped with existing light lattice pieces, in particular lattice pieces from the luffing fly jib of the crane. To be able to provide an optimum lifting capacity, they are assembled rotated by 90° in comparison to a use in the luffing fly jib. In this connection, reference is made to DE 10 2009 016 033 A1 which explicitly proposes the use and the rotated assembly of the lattice pieces from the luffing fly jib.

It may be expedient to insert an intermediate piece, in particular in the form of a cross-beam, between the two-strand or multi-strand region and the single strand region of the lattice mast boom. The single-strand region is thus arranged above the two-strand or multi-strand region so that the reinforced region of the boom is located with the at least two strands in the lower part of the lattice mast boom. An increased payload of the lattice mast boom hereby results since it has a higher load in the lower part than in the upper part due to the side loads and accordingly has less lateral deformation due to an increased side stiffness in the lower region.

In accordance with the invention, the lattice mast boom is in this respect advantageously structured substantially symmetrically with respect to the luffing plane extending through the central axis of the lattice mast boom for an ideal conducting away of force. In this respect, provision is advantageously made that the central axes of two strands in the two-strand or multi-strand region extending in parallel have the same spacing from the central axis of the pivotal connection piece and/or of the head piece and/or, if present, from the central axis of the boom strand in the single-strand region. The central axes of two strands extending in parallel thus advantageously have the same spacing from the central axis of the total lattice mast boom. It is hereby ensured that the two strands have substantially the same load and thus ideally contribute to the increase in the stiffness.

In further advantageous manner, the width of the lattice mast boom in the two-strand or multi-strand region corresponds to three times the width of a single main boom of identical lattice mast pieces or of the boom strand in the single-strand region of the boom. In the embodiment of the lattice mast boom having a two-strand or multi-strand region as well as a single-strand region, the respective two inner longitudinal braces of the assembled lattice pieces extend in the two-strand or multi-strand region substantially in planes spanned by the corresponding longitudinal braces of the lattice pieces of the single-strand region and/or of the pivotal connection piece and/or of the head piece so that the respective two inner longitudinal braces in the two-strand or multi-strand region are approximately aligned with the longitudinal braces in the single-strand region.

However, in the design stage before the manufacture of the lattice mast boom, the spacing of the least two strands can be varied with the aid of the side parts used in the two-strand or multi-strand region of the boom so that the width of the two-strand or multi-strand region can be adapted to the respective conditions in the lifting work. It is conceivable that the spacing between the at least two strands corresponds at least to the width of a lattice piece. This spacing can naturally also selectively be made smaller so that theoretically a contact of the at least two strands is also conceivable.

To keep the assembly effort as small as possible and to simplify it, the lattice pieces are mounted in the two-strand or multi-strand region and/or, if present, in the single-strand region, such that the longitudinal axis of the bolts used for establishing the bolt connections between the individual lattice pieces or the individual lattice pieces to the intermediate piece or pieces and/or to the pivotal connection piece and/or to the side part or parts and/or to the head piece extends transversely to the luffing plane. The individual heavy lattice pieces can hereby be bolted together in the usual normal position, which substantially simplifies the assembly of the crane. The disadvantage in particular results in the lattice mast crane known from DE 10 2009 016 033 that the light lattice pieces from the luffing fly jib used in the two-strand region have to be assembled rotated by 90° in comparison with a use in the luffing fly jib. The longitudinal axis of the bolt of the individual bolt connections therefore extends parallel to the luffing plane, which represents a substantial difficulty in the assembly of the lattice boom. It is particularly advantageous if all bolt connections between the lattice pieces and the cross-beam are designed with a longitudinal bolt axis transverse to the luffing plane.

As already shown, the lattice mast boom of the lattice mast crane in accordance with the invention is advantageously made up of standard lattice pieces such as are also used for constructing a lattice boom having only one strand of lattice pieces. The lattice mast crane is therefore advantageously operated in accordance with the invention while still using the pivotal connection piece and the head piece with a lattice boom of only one individual strand of lattice pieces. For example, in this respect, the side parts can easily be released from the pivotal connection pieces via the bolt connection.

It is conceivable that the lattice mast crane only provides one single hoist rope and/or one single hoist winch for carrying out the hoist work. It should herewith be clarified that the assembly of a two-strand or multi-strand region as well as optionally of a single-strand region serves the construction of a hoist system and in particular no hoisting systems arranged in parallel are envisaged. The lattice mast crane in accordance with the invention can naturally also have a plurality of hoist ropes or a plurality of winches for realizing a multi-rope operation.

In a particularly preferred embodiment of the invention, at least one lattice mast piece includes at least one receiver for depositing at least one ballast element of the lattice mast crane during transport. The ballast elements of the crane can hereby be transported in a particularly space-saving manner together with the lattice mast pieces of the lattice mast crane on a transport vehicle. The ballast elements are fastened in a space-saving manner to or in the lattice pieces, that is, to the receiver provided therefor, so that the transport dimensions permitted in road transport can be completely utilized by the dimensioning of the lattice mast pieces.

It is particularly advantageous when at least one mount is arranged in the hollow space of the lattice mast piece. As a rule, the lattice mast pieces describe a geometrical rectangular shape which has four longitudinal braces which are connected to one another via a respective two transverse braces at the end regions of the lattice mast piece. The hollow space resulting from the longitudinal and transverse brace arrangement has at least one receiver for the ballast elements of the lattice mast crane in accordance with the invention. If a corresponding ballast element is placed on the receiver in the hollow space of the lattice mast piece, the geometrical dimension of the lattice mast piece is thereby not influenced, or is only insignificantly influenced.

To prevent a slipping of the ballast elements on the receiver of the lattice mast piece, they are advantageously secured by corresponding means during the transport operation. For example, the individual ballast elements can be secured on the receiver separately or as a total unit at the receiver.

Provision can be made to increase the security that an additional transport security is present to secure at least one ballast element.

In a preferred embodiment of the lattice mast crane in accordance with the invention, at least one ballast element is designed as a ballast plate which has at least one throughgoing opening, in particular at the surface center. The throughgoing opening can serve the leading through of an elongated element to receive the ballast plate. For example, a plurality of ballast plates can be stacked over one another on such an elongated element in which said ballast plates are pushed onto the elongated element after one another via their throughgoing openings.

To place down the ballast plates having a throughgoing opening at the receiver in the lattice mast piece, a ballast system can preferably be provided. This includes an assembly apparatus having an elongated element which can be led through at least one opening of at least one ballast plate. Such a system is known from EP 1 607 364 A2 to which reference is made in full at this point. The assembly apparatus disclosed therein allows the stacking of one or more ballast plates by means of the elongated element which can be received via a receiving means by a lifting hook. At least one ballast element or one ballast plate can consequently be picked up with the aid of the crane hook, in particular by means of a C-hook, and placed in or on the receiver. The ballast plates can in particular be guided particularly simply into the hollow space of the lattice mast piece with the aid of a C-hook and can there be placed on the receiver arranged therein.

It has proven to be of advantage if one respective receiver is provided in the front and rear regions of the lattice mast piece, that is, in the region of the two ends of the lattice mast piece in the direction of its longitudinal axis. One or more ballast elements can thus be stacked on each receiver in the hollow space of the lattice mast piece and can be moved with it on the transport vehicle.

In addition to the lattice mast crane, the present invention furthermore includes a lattice mast boom for a corresponding lattice mast crane in accordance with the invention. Such a lattice mast boom in this respect has a pivotal connection piece, a plurality of uniform lattice pieces releasably connectable to one another and a head piece and is characterized in accordance with the invention in that it has a two-strand or multi-strand region, with in particular all lattice mast pieces used being uniform with respect to their geometrical dimensions. The use of heavy lattice mast pieces has proven to be particularly advantageous which are used in the construction of a main boom for a lattice mast crane known from the prior art. The lattice mast boom has in accordance with the invention at least one side part which can be releasably attached to the pivotal connection piece via a provided bolting site, whereby the receiver of the pivotal connection piece for the lattice mast pieces of the two-strand or multi-strand region can be widened. Furthermore, on the use of an intermediate piece in the connection between the pivotal connection piece and the two-strand or multi-strand region, an optimized flow of force through the lattice mast boom can be achieved by the bolted on side parts. Furthermore, a single-strand region of identical lattice pieces for adapting the crane lifting height can preferably be assembled between the head part and the two-strand or multi-strand region.

The advantageous embodiments of the lattice mast boom in accordance with the invention in this respect correspond to the advantageous embodiments of the lattice mast crane in accordance with the invention so that a repetition of the corresponding embodiments can be dispensed with.

The present invention will now be explained in more detail with reference to an embodiment and to the drawings. There are shown:

DESCRIPTION OF THE PREFERRED EMBODIMENTS

Figure 1A:
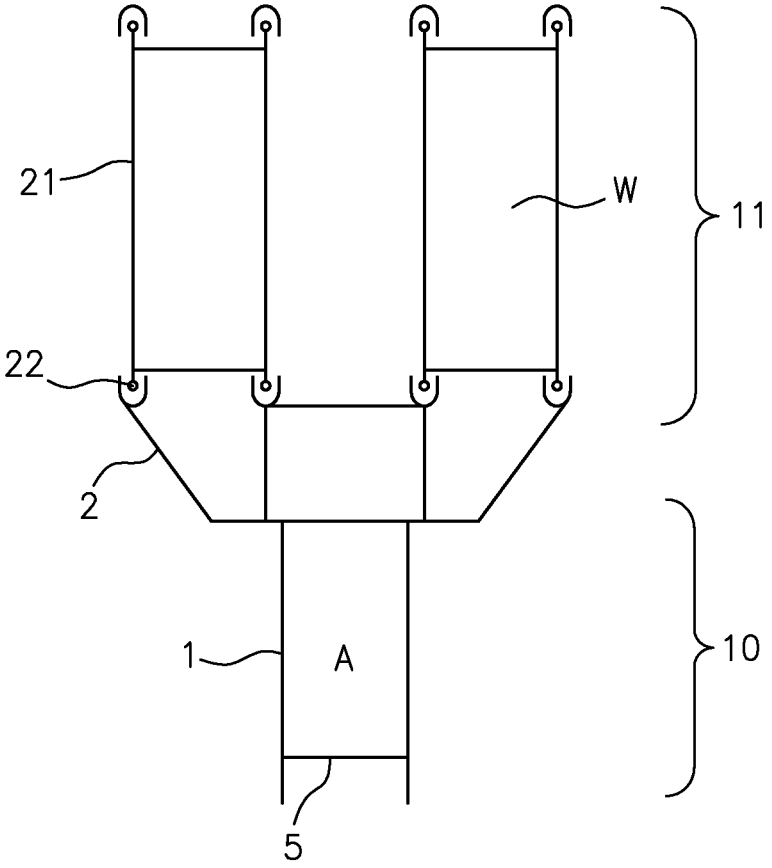
FIG. 1a (PRIOR ART)
FIG. 1*a*, FIG. 1*b*: schematic front views of a lattice mast boom known from the prior art.
Figure 1B:
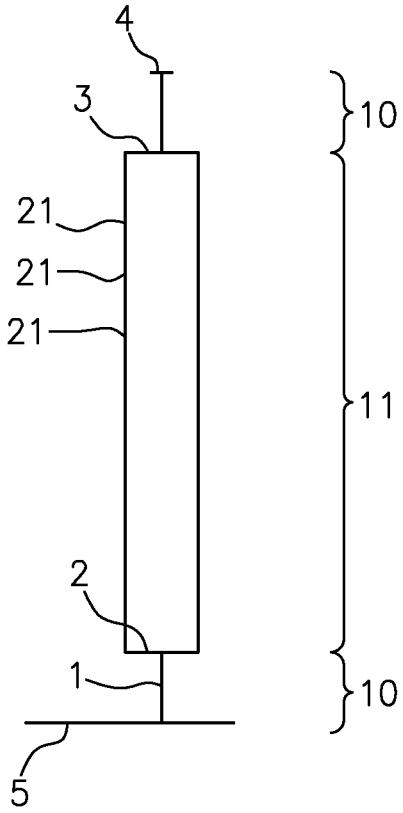
FIG. 1b (PRIOR ART)

The lattice mast boom known from the prior art of FIGS. 1*a* and 1*b* has already initially been described in more detail and will not be further explained at this point.

Figure 2:
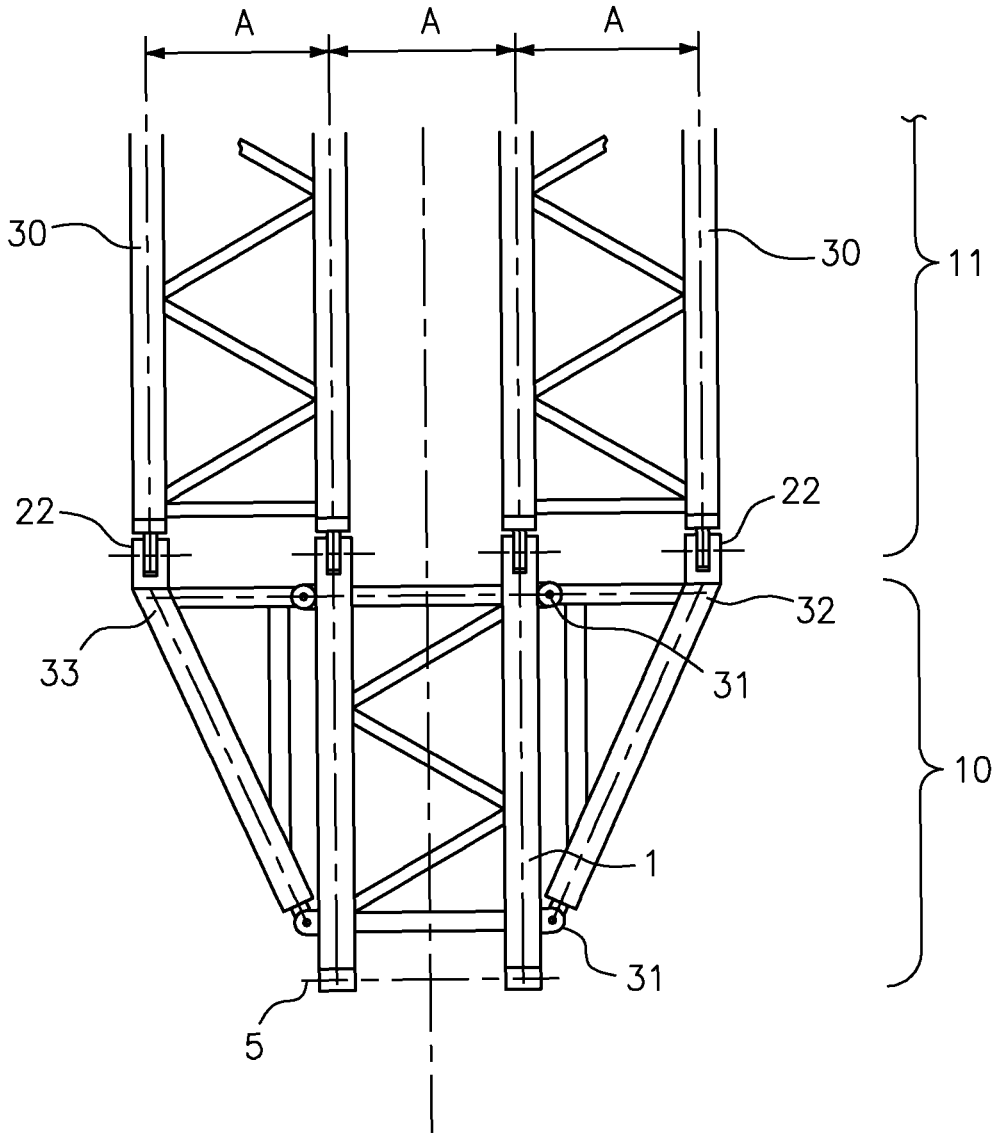
FIG. 2: a front view of a part of the lattice mast boom in accordance with the invention.

FIG. 2 shows a plan view of a part of the lattice mast boom in accordance with the invention. The embodiment shown now has a single-strand region 10 and a two-strand region 11, with the lattice mast boom comprising in the first region 10 the pivotal connection piece 1 and the two laterally arranged side parts 32, 33 which are here bolted to the pivotal connection piece 1 via the bolting sites 31. The two-strand region 11 comprises mutually connected lattice pieces 30 which extend in parallel in the longitudinal direction of the boom and are connected at the upper end to the head piece, not shown, of the boom, with the head piece likewise being able to be equipped with side parts analog to the pivotal connection piece 1.

A single-strand region can be interposed between the head part and the two-strand region 11 of the boom and can likewise comprise mutually connected individual lattice pieces 30. The lattice pieces used in the single-strand and multi-strand regions are preferably identical with respect to their dimensions. The single-strand region can, however, generally be assembled from smaller and/or lighter lattice mast pieces.

The lattice pieces 30 used are identical components with respect to their geometrical dimensions and are bolted to one another to form a strand of lattice pieces. The lattice pieces 30 thus have the same dimensions and connection pieces among one another. They can, however, by all means be different in their designs. For instance, lattice pieces 30 which are installed further toward the top can have a smaller wall thickness in the tubes used than those lattice pieces 30 which are installed further below in the boom. Additional reinforcements of the lattice pieces can expediently also be present to reinforce specific regions in the boom of the lattice mast crane.

The individual lattice pieces 30 have a rectangular cross-section. Each lattice piece 30 in this respect includes four longitudinal braces which are connected to one another at their end regions via cross-braces. Furthermore, as can be seen from FIG. 2, further bracing arrangement elements are provided to produce a structure of force triangles. The individual lattice pieces 30 have connection points at their end regions via which they are bolted to one another or to the pivotal connection piece 1 and/or to the head piece and/or to the intermediate pieces 2 and/or to the side parts 32, 33. The connection points are in this respect located in the corners of the rectangular cross-sectional surface in the end region of the longitudinal braces.

In the embodiment of FIG. 2, the bottommost lattice mast pieces 30 of the two boom strands in the region 11 are each bolted by two respective connection points to the pivotal connection piece 1 and by the respective two outwardly lying connection points of the triangular side parts 32, 33 at the bolt-on points 22. The length A represents the spacing of the longitudinal axes from the corner stems of the lattice pieces 30. The width of the lattice pieces is larger by the diameter of the corner stem pieces than A; the unstrained members are smaller than A by the diameter of the corner stem tubes.

The side parts 32, 33 in accordance with the invention have a prismatic geometrical body which has a triangular base surface. The front and rear triangular base surface of the side parts 32, 33 is bolted to the longitudinal braces of the pivotal connection piece 1 via at least two bolting sites 31 arranged in the corners of the triangular base surface of the side parts 32, 33. In this respect, the side parts 32, 33 are connected to the pivotal connection piece 1 such that the surface of the pivotal connection piece for receiving the boom strands through the side parts 32, 33 is widened by their surface.

The heavy lattice pieces 30 can be bolted together in the normal position for the assembly of the boom, i.e. the longitudinal axis of the used bolt of the bolt connection 22 extends transversely to the spanned luffing plane of the lattice mast boom. The individual lattice mast pieces 30 can thus be assembled on one another by usual worksteps. The width of the boom in the two-strand region 11 is tripled in the embodiment of FIG. 2 in comparison with the single-strand region. The two strands in the region 11 are arranged at a spacing A, i.e. the width of the lattice mast pieces 30, from one another on the pivotal connection piece or on the bolted-on side parts 32, 33. Accordingly, a total width of the boom region 11 hereby results with triple the value of the spacing A.

The head piece is then bolted to the two-strand region 11. As a rule, the connection takes place analog to the pivotal connection pieces 1, i.e. likewise while optionally using side parts which widen the pivotal connection base of the head part. Furthermore, as known from DE 10 2009 016 033 A1, a single-strand region 10 having further lattice pieces 30 and/or light lattice pieces can also be interposed.

Figure 3:
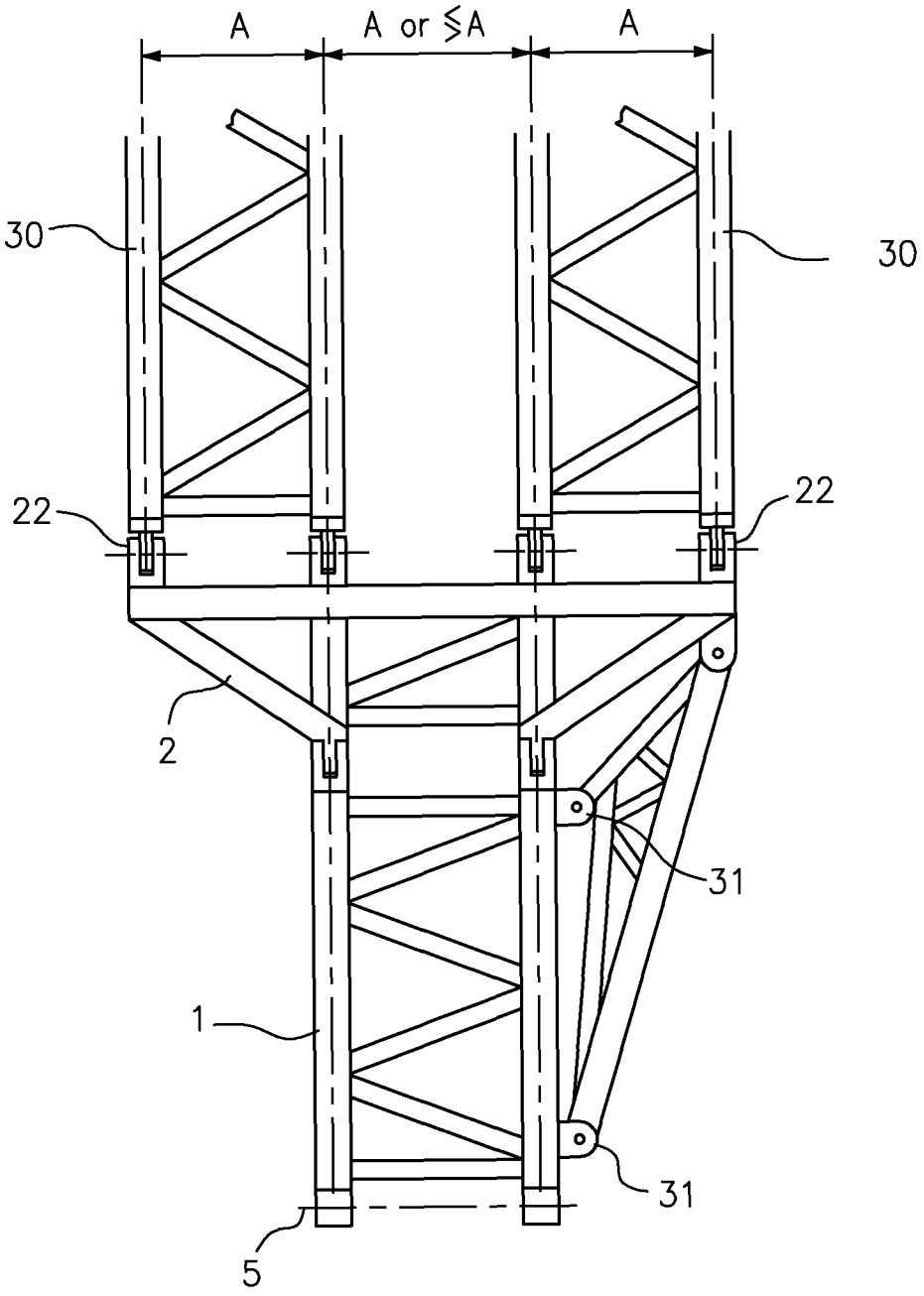
FIG. 3: a front view of a part of the lattice mast boom in accordance with the invention in an alternative embodiment.

An alternative embodiment can be seen from FIG. 3. In this respect, an intermediate piece 2 is assembled between the connection of the pivotal connection piece 1 and the lattice mast pieces 30 of the two-strand region 11. To optimize the flow of force through the lattice mast boom, the side parts 32, 33 are likewise bolted to the pivotal connection piece 1 in a known manner in the bolting sites 31. In contrast to the embodiment of FIG. 2, however, the third bolting site of the side parts 32, 33 is not bolted to the lattice pieces 30, but to the assembled intermediate piece 2. The assembled intermediate piece 2 is in this respect adapted to the required width which the two-strand region 11 should adopt during the lift.

The lattice mast pieces 30 are bolted via the connection points 22 arranged at their corner points to the intermediate piece 2 which in particular has the shape of a cross-beam. The spacing which the two strands of the lattice pieces 30 adopt with one another in this respect depends on the provided width of the intermediate piece 2. The intermediate piece 2 is matched to the permitted transport size for road transport. In accordance with the invention, the longitudinal axis of the used bolts in the individual bolt connections 22 likewise extends transversely to the spanned luffing plane.

Figure 4:
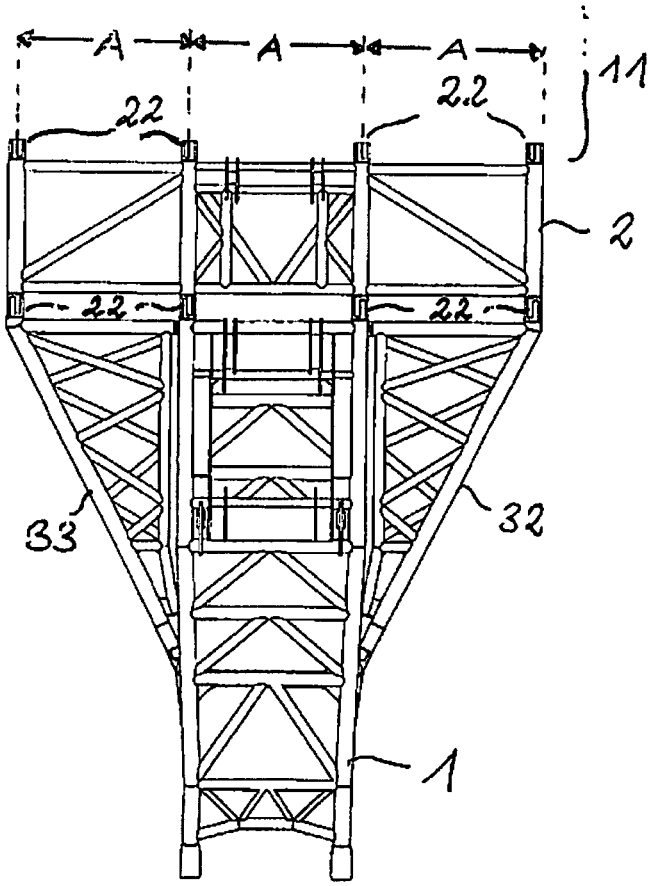
FIG. 4: a front view of a part of the lattice mast boom in accordance with the invention in a further alternative embodiment.
Figure 5:
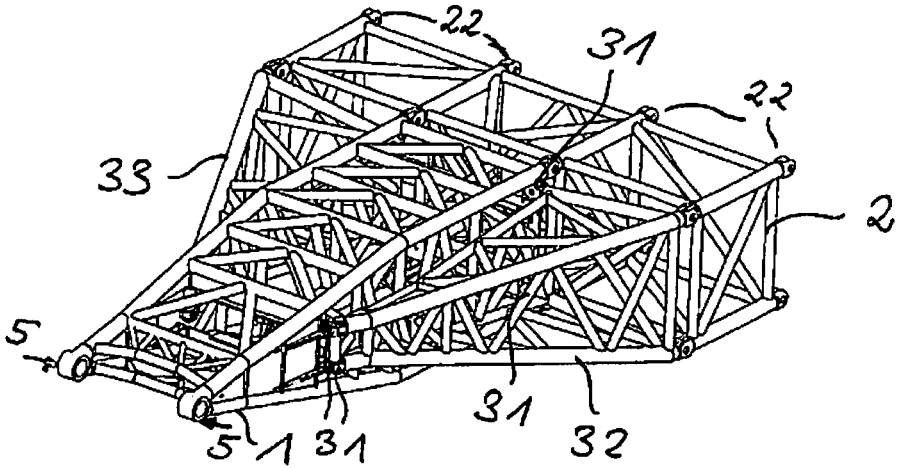
FIG. 5: a perspective view of the lattice mast boom of FIG. 4.

FIGS. 4 and 5 show, in a lateral and perspective view, a further embodiment of the lattice mast crane in accordance with the invention which can be considered as a kind of mixed form of the above-explained embodiments. As in FIG. 3, a pivotal connection piece 1 to which the two side parts 32, 33 are laterally bolted on both sides via the bolting sites 31 is provided in the embodiment of FIGS. 4 and 5. The cross-beam 2 is bolted to the pivotal connection piece 1 and to the two side parts 32, 33, with all the longitudinal axes of the bolting sites 22 extending transversely to the luffing plane. In the embodiment of FIGS. 4 and 5, the inserted cross-beam 2, however, does not change the system dimension A of the multi-strand boom region 11. Analog to FIG. 2, a total width of the boom region 11 is achieved by the cross-beam 2 of FIGS. 4, 5 with triple the value of the spacing A, with A representing the spacing between the longitudinal axes of the corner stems of the lattice pieces.

Alternatively, the lattice mast crane in accordance with the invention can also be assembled such that only a single boom strand results. In this respect, the individual lattice mast pieces 30 are connected to one another in a known manner and are either directly bolted to the pivotal connection piece 1 or are alternatively mounted directly on the intermediate piece 2 via an interposed intermediate piece 2.

The invention naturally includes any desired setup conditions. A fly boom can thus naturally also adjoin the main boom comprising the pivotal connection piece, the parallel region and the single-strand region, for example.

A non-problematic retrofittability of the crane in accordance with the invention results by the present invention. The crane operators can thus increase the payload of their cranes at manageable cost since only either at least one intermediate piece or one modified pivotal connection piece is required.

The invention claimed is:

1. A lattice mast crane having a lattice mast boom arranged to be be luffed up in a vertical luffing plane and which comprises a pivotal connection piece, a plurality of lattice pieces arranged to be releasably connectable to one another and form a lateral multi-strand region in the lattice boom, wherein at least one side part is releasably connectable to the pivotal connection piece and at least one of the lattice pieces in the multi-strand region, the pivotal connection piece is centrally disposed between lattice pieces forming the lateral multi-strand region in a longitudinal direction of the boom and has a substantially rectangular cross-section, said at least one side part is laterally arranged against the pivotal connection piece and bolt connections between the lattice pieces and both the pivotal connection piece and at least one side part extend transversely to the longitudinal direction of the boom.

2. A lattice mast crane in accordance with claim 1, wherein the pivotal connection piece has at least one lateral bolting site for fastening at least one side part.

3. A lattice mast crane in accordance with claim 1, wherein the two-strand or multi-strand region is connected to the pivotal connection piece via an intermediate piece, in particular via a cross-beam.

4. A lattice mast crane in accordance with claim 3, wherein the intermediate piece is connected to the pivotal connection piece and additionally to at least one side part of the pivotal connection piece, by at least one bolt connection.

5. A lattice mast crane in accordance with claim 1, wherein the connections between the lattice pieces or of the lattice pieces to the intermediate piece or pieces and/or to the pivotal connection piece and/or to the side part are bolt connections, with the longitudinal axis of at least one bolt extending transversely to the luffing plan.

6. A lattice mast crane in accordance with claim 5, wherein all the bolt connections between the lattice pieces and the cross-beam are designed with a longitudinal bolt axis transversely to the luffing plane.

7. A lattice mast crane in accordance with claim 1, wherein the two-strand or multi-strand region is connected to the single-strand region via an intermediate piece, via a cross-beam.

8. A lattice mast crane in accordance with claim 1, wherein the width of the lattice mast boom in the multi-strand region is approximately tripled in comparison with a single-strand region.

9. A lattice mast crane in accordance with claim 1, wherein said at least one side part has triangular base surface.

10. A lattice mast crane in accordance with claim 1, comprising two said lattice pieces arranged side-by-side in the multi-strand region in a direction transverse to the longitudinal direction of the boom, two said side parts arranged on opposite sides of said pivotal connection piece and connectable to said pivotal connection piece at bolting sites, and four said bolt connection (22), two said bolt connections inwardly-positioned in the transverse direction for connecting a respective one of said two lattice pieces to said pivotal connection piece and two said bolt connections outwardly-positioned in the transverse direction for connecting a respective one of said side parts to said pivotal connection piece.

11. A lattice mast crane in accordance with claim 10, wherein a transverse width of each of the lattice mast pieces as measured from corner stem regions thereof in the multi-strand region is substantially identical and transverse width of (A) the pivotal connection piece between corner stem regions thereof is also substantially identical to the transverse width of the adjacent lattice mast pieces in the multi-strand region.

* * * * *